US009775478B2

(12) United States Patent
Schultz

(10) Patent No.: US 9,775,478 B2
(45) Date of Patent: Oct. 3, 2017

(54) LOW PROFILE FILTER FOR VACUUM CLEANERS

(71) Applicant: Douglas Schultz, Glen Carbon, IL (US)

(72) Inventor: Douglas Schultz, Glen Carbon, IL (US)

(73) Assignee: EMERSON ELECTRIC CO., St. Louis, MO (US)

( * ) Notice: Subject to any disclaimer, the term of this patent is extended or adjusted under 35 U.S.C. 154(b) by 368 days.

(21) Appl. No.: 14/454,758

(22) Filed: Aug. 8, 2014

(65) Prior Publication Data

US 2016/0037988 A1 Feb. 11, 2016

(51) Int. Cl.
*A47L 9/12* (2006.01)
*A47L 5/36* (2006.01)

(52) U.S. Cl.
CPC ..... *A47L 9/12* (2013.01); *A47L 5/365* (2013.01)

(58) Field of Classification Search
CPC ... A47L 5/365; A47L 9/10; A47L 9/20; A47L 9/12; A47L 9/1427; A47L 9/1409
See application file for complete search history.

(56) References Cited

U.S. PATENT DOCUMENTS 5,201,095 A * 4/1993 Choi ..... A47L 7/0028 15/319
6,444,003 B1 * 9/2002 Sutcliffe ..... B01D 46/2403 15/340.4
8,418,312 B2 4/2013 Rhea et al.
2005/0055794 A1 * 3/2005 Marshall ..... A47L 5/225 15/353
2007/0056135 A1 * 3/2007 Sasaki ..... A47L 9/122 15/347
2010/0162516 A1 * 7/2010 Gierer ..... A47L 5/22 15/339
2013/0111694 A1 * 5/2013 Morgan ..... A47L 5/30 15/323

* cited by examiner

*Primary Examiner* — Robert Scruggs
(74) *Attorney, Agent, or Firm* — Sutton McAughan Deaver PLLC

(57) ABSTRACT

A vacuum cleaner having a power head, a collection drum, and a filter. The filter of the present invention is of rectangular cross section about the vertical axis, but is curved away from the power head under the blower along at least one horizontal axis.

14 Claims, 2 Drawing Sheets

LOW PROFILE FILTER FOR VACUUM CLEANERS

CROSS REFERENCE TO RELATED APPLICATIONS

None.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to vacuum cleaners; and more specifically relate to space constrained vacuum cleaners.

Description of the Related Art

U.S. Pat. No. 8,418,312 teaches "improved wet/dry vacuum appliance assemblies and associated systems which facilitate the ease of removal of the filter assembly from within the appliance itself. The vacuum appliance assemblies described include a drum, a lid assembly adapted to removably mount on or to hinge on the drum, and a filter assembly housed within the lid assembly, wherein the lid assembly comprises a removable component such that if the removable component is removed, the filter assembly is accessible. Also described herein are methods of removing such a filter assembly from a wet/dry vacuum appliance, wherein the method includes removing a component of the lid assembly of the wet/dry vacuum in order to make the filter assembly accessible, grasping a handle of a filter assembly housed within the lid assembly of the wet/dry vacuum appliance, rotating the filter assembly so as to disengage it from a sealing relationship with the lower portion of an interior region of the lid assembly, and then removing the filter assembly from the vacuum appliance by pulling generally in an upward direction."

The inventions disclosed and taught herein are directed to an improved filter for vacuum cleaners.

BRIEF SUMMARY OF THE INVENTION

A vacuum cleaner having a power head, a collection drum, and a filter. The vacuum cleaner of the present invention may be similar to the conventional wet/dry vacuums, upright vacuums, canister vacuums, and/or backpack vacuums. For example, in most embodiments, the power head will include a motor driven fan or blower to induce airflow through the vacuum cleaner and thereby lift and entrain debris for capture within the drum of vacuum cleaner. In the case of a wet/dry vacuum, the drum of the present invention would be positioned below the power head and the filter would also typically be positioned below the power head or blower.

The filter of the present invention is, however, not typical. For example, typical wet/dry vacuums utilize a cylindrical filter that is of circular cross section about a vertical axis. Instead, the filter of the present invention is preferably of rectangular cross section about the vertical axis. However, it has been found that a flat, planar filter is not ideal, as the airflow may be focused on that portion of the filter directly under the blower. As such, the filter of the present invention is curved, or bowed, away from the power head under the blower.

DETAILED DESCRIPTION OF THE INVENTION

Figure 1:
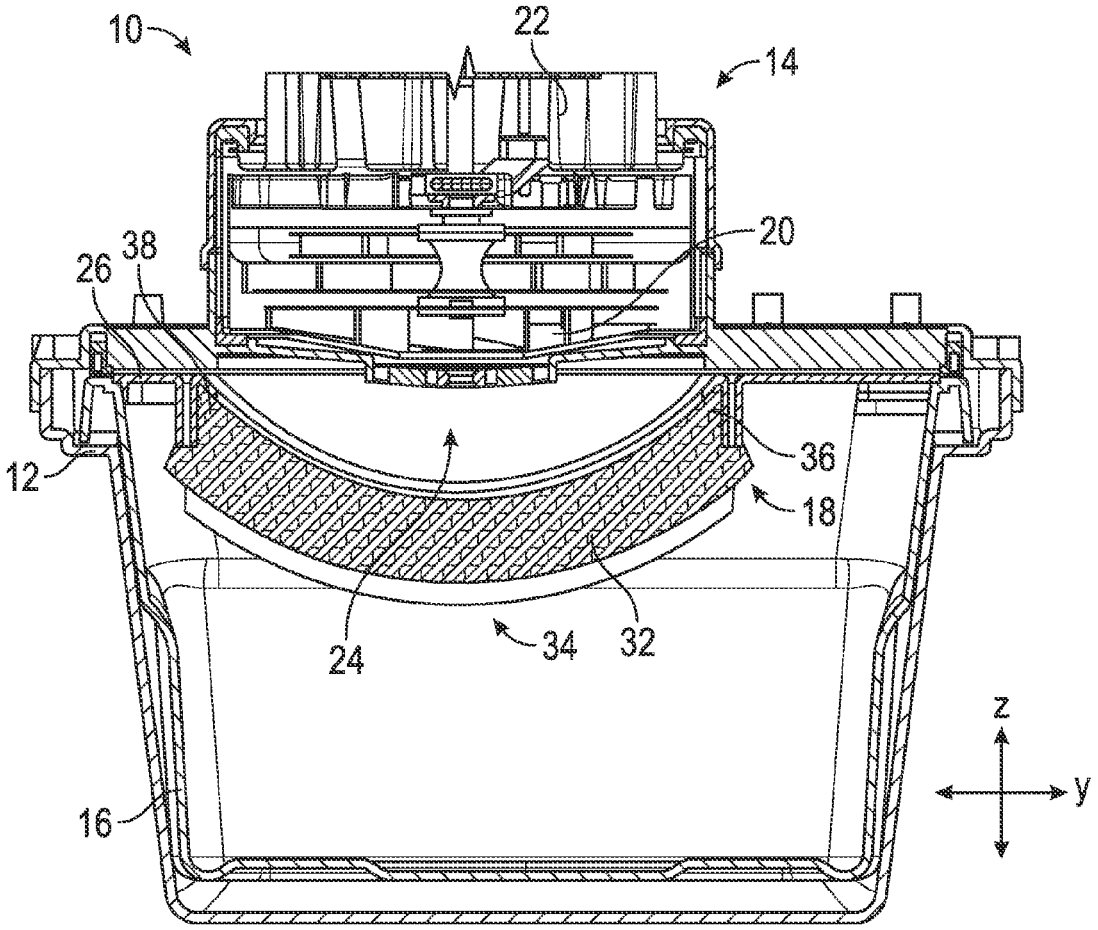
FIG. 1 illustrates a cross-sectional view of a particular embodiment of a vacuum cleaner utilizing certain aspects of the present inventions.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicant has created a vacuum cleaner having a power head, a collection drum, and a filter. The vacuum cleaner of the present invention may be similar to the conventional wet/dry vacuums, upright vacuums, canister vacuums, and/or backpack vacuums. The vacuum cleaner of the present invention may be similar to that disclosed in U.S. Pat. No. 8,418,312, which is incorporated herein by specific reference. For example, in most embodiments, the power head will include a motor driven fan or blower to induce airflow through the vacuum cleaner and thereby lift and entrain debris for capture within the drum of vacuum cleaner. In the case of a wet/dry vacuum, the drum of the present invention would be positioned below the power head and the filter would also typically be positioned below the power head or blower.

The filter of the present invention is, however, not typical. For example, typical wet/dry vacuums utilize a cylindrical filter that is of circular cross section about a vertical axis. Instead, the filter of the present invention is preferably of rectangular cross section about the vertical axis. However, it has been found that a flat, planar filter is not ideal, as the airflow may be focused on that portion of the filter directly under the blower. As such, the filter of the present invention is curved, or bowed, away from the power head under the blower.

FIG. 1 is an illustration of vacuum cleaner 10 utilizing certain aspects of the present inventions. The vacuum cleaner 10 includes a housing 12, or other support structure, supporting a power head 14, a debris collecting container or drum 16, and a filter 18. The power head 14 includes a fan or blower 20 to induce airflow through the vacuum 10 and thereby lift and entrain debris for collection in the drum 16. The blower 20 is driven, directly or indirectly, by a motor 22. More specifically, the motor-driven fan 20 preferably draws air through an inlet 24 in the power head 14. To ensure proper operation of the vacuum 10, the air flowing into the inlet 24 and through the power head 14, possibly past the motor 22, is preferably relatively clean filtered air. As such, the filter 18 is preferably located or positioned upstream of the power head 14, fan 20, and/or inlet 24.

In a space constrained vacuum cleaner, the filter 18 may need to be placed adjacent, or right next to, the power head 14, fan 20, and/or inlet 24. Of course, the filter 18 may be adjacent the power head 14 even where overall physical space is not a primary concern. In any case, a conventional wet/dry vacuum typically uses a cylindrical filter that is linear along, but circular about a vertical axis. However, this requires the filter to extend away from the inlet 24. Often, these filters are disposed within the debris container, such that larger, and/or longer filters can take up significant space within the container.

On the other hand, it has been found that flat, planar filters—especially those placed close to the fan inlet—may not be ideal in that the airflow induced therethrough may be primarily focused on a small portion of the filter. This can be alleviated somewhat by moving the filter further from the fan inlet. But, this may also occupy significant space within the container.

The filter 18 of the present invention has been designed to maximize the useful capacity of the drum 16, while preventing concentration of the airflow. As shown in FIG. 1, the filter 18 may be positioned within the drum 16, directly under and adjacent, or right next to, the power head 14, fan 20, and/or inlet 24. However, due to the unique features of the filter 18, it occupies relatively little space within the drum 16, while preventing concentration of the airflow.

Figure 2:
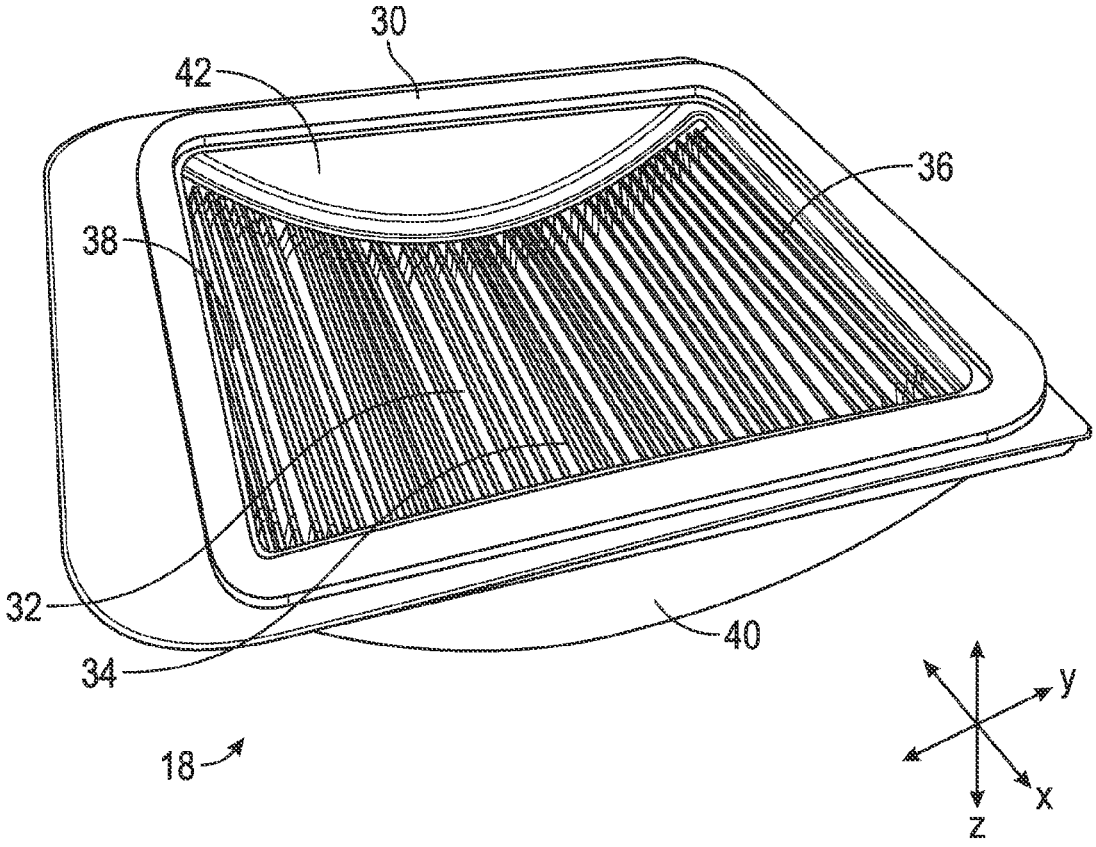
FIG. 2 illustrates a perspective view of a particular embodiment of a vacuum cleaner filter utilizing certain aspects of the present inventions.

Referring also to FIG. 2, the filter 18 comprises a frame 30 surrounding a filter element or media 32. In the preferred embodiment, the filter media 32 is pleated paper. The frame 30 may be resilient to assist in sealing to the drum 16, or lid 26 thereof, and/or the power head 14. As shown, the frame 30 preferably has a rectangular cross section about one axis, such as a vertical axis Z. More specifically, in operation, the rectangular cross section of the frame 30 is horizontal, such that the cross section is defined by a plane extending along the X and Y axes. However, other shapes and/or orientations are envisioned.

As can also be seen, the filter element 32 is curved along one of the horizontal axis, such as the Y axis. As shown, the filter element 32 is substantially linear along the X axis. However, the filter element 32 may also be curved along the X axis, in other embodiments. One thing to note here, is that a center or middle portion 34 of the filter media 32 is spaced apart from the power head 14, fan 20, and/or inlet 24, while opposing edges 36,38 thereof are adjacent, or right next to, the power head 14. Said another way, the center or middle portion 34 of the filter media 32 is deeper within the drum 16 than the opposing edges 36,38. This works to spread the airflow across more of the filter media 32 than would be the case if the center of the filter media was adjacent, or right next to, the power head 14. This structure does not need to occupy as much space within the drum 16 as a more traditional cylindrical filter of similar capacity would.

The frame 30 also preferably include bowed sidewalls 40,42 to sealingly engage the filter media 32 about its entire periphery, while accommodating the curved nature thereof. However, the bowed sidewalls 40,42 could include filter media elements, or be comprised entirely of the filter media.

Other and further embodiments utilizing one or more aspects of the inventions described above can be devised without departing from the spirit of Applicant's invention. For example, while the filter of the present invention was originally envisioned for use with small wet/dry vacuums, it may be used with larger more conventional wet/dry vacuums, or anywhere one wishes to maximize the usable capacity of the debris collector. In fact, the filter of the present invention is not limited to wet/dry vacuums, and may be useful in upright vacuums, canister vacuums, and/or backpack vacuums. Additionally, while the filter media 32 has been described as curved, it may be linear, and stepped or angled away from the inlet 24. Further, the various methods and embodiments of the present invention can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A vacuum cleaner comprising:

a power head including— a blower to induce airflow through the vacuum cleaner and thereby lift and entrain debris for capture within the vacuum cleaner, and a motor to drive the blower;

a debris container to collect the debris; and a filter comprising filter media that is adjacent the power head along at least two edges of the filter media and spaced from the power head at a center of the filter media, the filter including a frame having a rectangular horizontal cross section and defining a horizontal X and a perpendicular horizontal Y axis, wherein the filter media is supported by the frame and is linear along the X axis and arcuate along the Y axis.

2. The vacuum cleaner of claim 1, wherein the filter is positioned within the debris collection drum such that a middle portion of the filter is lower in the drum than first and second opposing edge portions of the filter.

3. The vacuum cleaner of claim 1, wherein the filter is positioned such that a middle portion of the filter is further from the blower than first and second opposing edge portions of the filter.

4. The vacuum cleaner of claim 1, wherein the filter media is pleated.

5. The vacuum cleaner of claim 1, wherein the filter media is curved along at least one horizontal axis.

6. The vacuum cleaner of claim 1, wherein the filter media is paper.

7. A vacuum cleaner comprising:

a power head including— a blower to induce airflow through the vacuum cleaner and thereby lift and entrain debris for capture within the vacuum cleaner, and a motor to drive the blower;

a debris collection drum positioned below the power head; and a filter positioned below the blower, the filter including filter media that is curved along at least one horizontal axis, such that a middle portion of the filter media is further from the blower than first and second opposing edge portions of the filter media, the filter including a frame having a rectangular horizontal cross section and defining a horizontal X and a perpendicular horizontal Y axis, wherein the filter media is supported by the frame and is linear along the X axis and arcuate along the Y axis.

8. The vacuum cleaner of claim 7, wherein the filter is within the debris collection drum such that the middle portion of the filter is lower in the drum than the first and second opposing edge portions of the filter.

9. The vacuum cleaner of claim 7, wherein the filter media is pleated.

10. The vacuum cleaner of claim 7, wherein the filter media is paper.

11. A vacuum cleaner comprising:

a power head including— a blower to induce airflow through the vacuum cleaner and thereby lift and entrain debris for capture within the vacuum cleaner, and a motor to drive the blower;

a debris collection drum positioned below the power head; and a filter positioned below the blower, such that a middle portion of the filter is further from the power head than first and second opposing edge portions of the filter, the filter including a frame having a rectangular horizontal cross section and defining a horizontal X and a perpendicular horizontal Y axis, wherein the filter media is supported by the frame and is linear along the X axis and arcuate along the Y axis.

12. The vacuum cleaner of claim 11, wherein the filter media is pleated.

13. The vacuum cleaner of claim 11, wherein the filter is within the debris collection drum such that a middle portion of the filter is lower in the drum than first and second opposing edge portions of the filter.

14. The vacuum cleaner of claim 11, wherein the filter media is paper.

* * * * *